US005118249A

United States Patent [19]

Romagnoli

[11] Patent Number: 5,118,249

[45] Date of Patent: Jun. 2, 1992

[54] APPARATUS FOR SUPPLYING INDIVIDUAL BLANKS STACKED SIDEWAYS IN A HIGH-CAPACITY STORE PARTICULARLY FOR PACKAGING MACHINES

[75] Inventor: Andrea Romagnoli, San Lazzaro Di Savena, Italy

[73] Assignee: Cestind - Centro Studi Industriali S.R.L., San Pietro Terme, Italy

[21] Appl. No.: 598,181

[22] Filed: Oct. 15, 1990

[30] Foreign Application Priority Data

Nov. 7, 1989 [IT] Italy ..... 3688 A/89

[51] Int. Cl.[5] ..... B65G 59/10

[52] U.S. Cl. ..... 414/798.9; 414/797.8; 271/150

[58] Field of Search ..... 414/797.8, 798.9; 271/149, 150

[56] References Cited

U.S. PATENT DOCUMENTS

| | | | |
|---|---|---|---|
| 2,692,774 | 10/1954 | Sidman | 271/133 X |
| 3,655,072 | 4/1972 | Bateman | 414/795.8 X |
| 3,947,017 | 3/1976 | Seragnoli | 414/797.8 X |
| 3,952,635 | 4/1976 | Mims | 414/797.8 X |
| 3,953,021 | 4/1976 | Seragnoli | 414/797.4 X |
| 4,042,126 | 8/1977 | Blauvelt et al | 414/798.9 |
| 4,093,083 | 6/1978 | Klaus | 414/798.9 X |
| 4,135,710 | 1/1979 | Seragnoli | 414/797.8 X |
| 4,537,208 | 8/1985 | Kuhl | 271/150 X |
| 4,564,188 | 1/1986 | McNair | 414/798.9 X |

FOREIGN PATENT DOCUMENTS

| | | | |
|---|---|---|---|
| 841288 | 7/1960 | United Kingdom . | |
| 1217578 | 12/1970 | United Kingdom . | |
| 2198711 | 6/1988 | United Kingdom | 414/798.9 |

*Primary Examiner*—Robert J. Spar
*Assistant Examiner*—Craig Slavin
*Attorney, Agent, or Firm*—Herbert Dubno; Yuri Kateshov

[57] ABSTRACT

An apparatus for supplying individual blanks stacked sideways in a store with an inclined conveyor channel comprises a divider with a conveyor for receiving, under control, a divided sequence of blanks from this conveyor channel, two oppositely inclined planes following closely on from the conveyor channel and above this divider and an oscillating device with a reciprocating movement provided with suction cups for taking up the blanks in individual sequence from the divided sequence and depositing them in a horizontal position on a production line.

5 Claims, 4 Drawing Sheets

20
20b
20c
20a
38
39
37a
37b
36
37
38a
39a
23
41
S
1
39b
38b
5'
24
13'
19
14
5
7
8
13
30
15
31
18
16
9

APPARATUS FOR SUPPLYING INDIVIDUAL BLANKS STACKED SIDEWAYS IN A HIGH-CAPACITY STORE PARTICULARLY FOR PACKAGING MACHINES

FIELD OF THE INVENTION

The present invention relates to an apparatus for supplying individual plane blanks stacked sideways in a store with a high storage capacity which is particularly appropriate for high-speed machines for packaging products in general in boxes of the hinged-lid type with a guarantee seal.

BACKGROUND OF THE INVENTION

In order to supply individual flat blanks to packaging machines in general, most known apparatuses take the flat blanks in individual sequence from the base of a vertical tank or store which is normally loaded manually or possibly automatically via a reserve channel which is horizontal or inclined downwards in the downstream direction in which the flat blanks are disposed in adjacent stacks in the first case (see for instance the U.S. Pat. No. 3,953,021) and stacked sideways in the second case (see U.S. Pat. No. 3,655,072).

In order to facilitate the take-up of the flat blanks in individual sequence from the vertical tank or store the opposite sides or flanks of the stack of flat blanks within the vertical tank or store are normally provided with separation means with alternately moving members (see for instance the U.S. Pat. Nos. 2,692,774 and 3,947,017) or members with a rotary movement of the rachet or successive-step type (see for instance U.S. Pat. No. 4,135,710) or which cause them to drop down within the store in small quantities as for instance in the case of the above-mentioned U.S. Pat. No. 3,655,072.

The GB Patent Specification 841 288 of Apr. 17, 1957 also discloses an apparatus or device for supplying flat blanks which are stacked sideways from a store with a high storage capacity which is inclined downwards in the downstream direction and whose base is provided with orbitally moving members intended to cause the flat blanks to advance with a jerky delaying movement to the store outlet where the lower portion of each blank is taken up in individual sequence by suction cup take-up means and folded outwardly in order to disengage it from an end retaining stop of the inclined store as a result, moreover, of the fact that in this specific case the zone for take-up by the suction cup is formed by one of the flaps for the production of the box which is defined by a fold line with the result that in this case as well the means designed to free the column from its own weight and simultaneously supply them in a separate arrangement to facilitate their individual extraction are of the dynamic type overall, i.e. of the operationally moving type.

OBJECT OF THE INVENTION

The principal object of the present invention is to provide an apparatus designed to supply individual flat blanks stacked sideways in a store with a high storage capacity of the type having the structure of a conveyor channel inclined downwards in the downstream direction which is particularly simple and economic and has substantially static separation means.

SUMMARY OF THE INVENTION

The present invention relates to an apparatus for supplying individual flat blanks stacked sideways in a store with a high storage capacity of the type having the structure of a conveyor channel inclined downwards in the downstream direction, characterized in that it comprises, downstream of this inclined conveyor channel, a divider device with conveyor means designed to receive, under control, a divided sequence of flat blanks from the conveyor channel, a first and a second means with opposite inclined planes disposed to follow one another closely in order in the downstream direction and ensuring the continuity of the conveyor plane of the conveyor channel and above the divider device at a distance substantially equal to the upward direction of the flat blanks and alternately oscillating means with a a reciprocating movement with suction cups for the take-up in individual sequence of the flat blanks from this divided sequence supplied by the divider device and for depositing them in a horizontal position on a production line.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
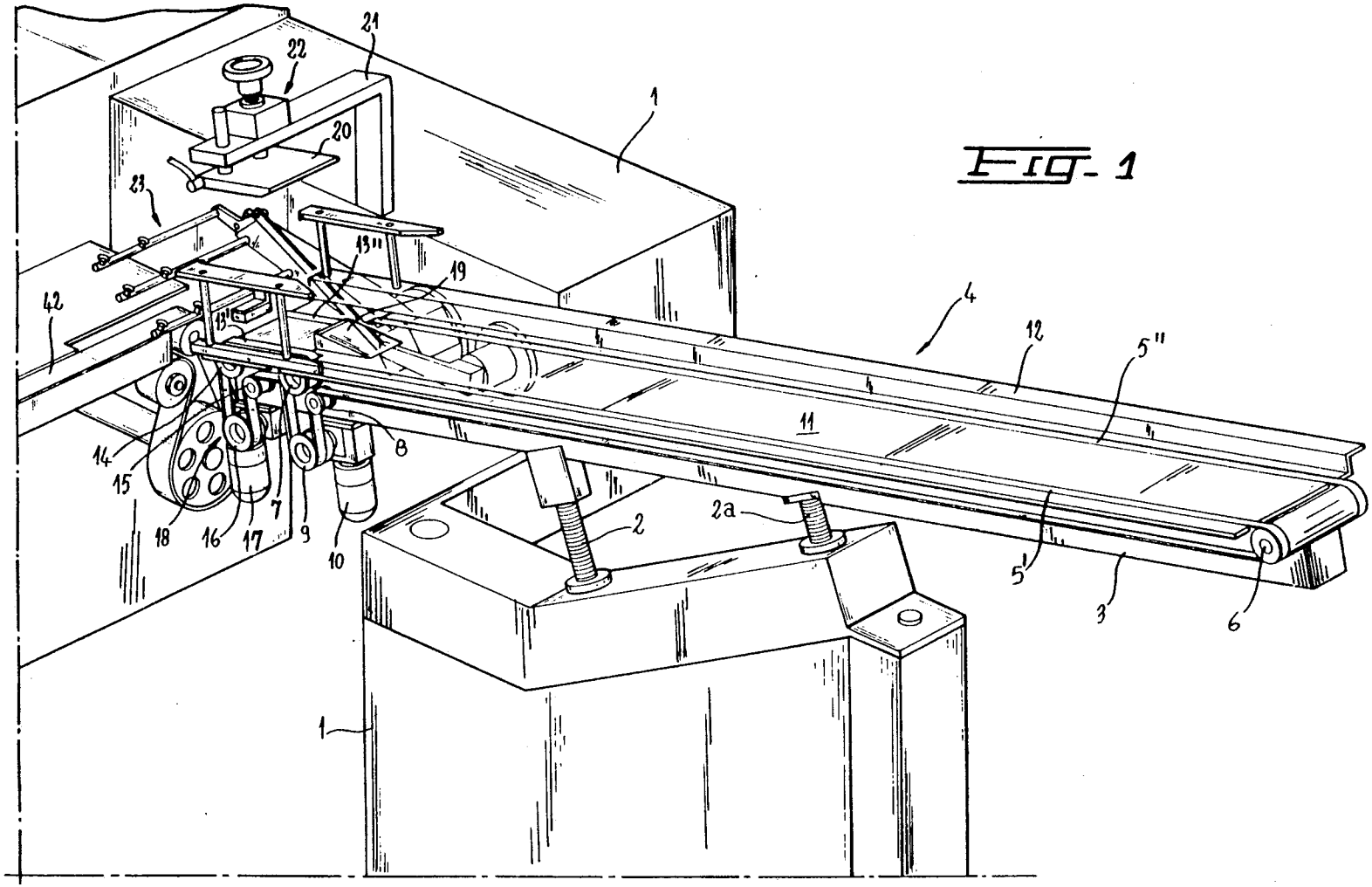
FIG. 1 is a perspective diagrammatic view of this apparatus with front, longitudinal foreshortening.

With reference to FIG. 1 which, as mentioned above, is a perspective view of the apparatus in question, it can be seen that 1 designates a base designed to support, via screw means 2 and **2*a* for adjusting the inclination of the corresponding store, a longitudinal member 3 supporting the apparatus itself and in particular its store with a high storage capacity shown overall by 4. This store 4 with a high storage capacity substantially comprises two conveyor belts 5' and 5'' spaced in a transversely parallel manner and wound in the form of closed loops about return rollers 6, 7, 8 and 9, the latter being driven by a geared motor 10, a slide plate 11 disposed in a coplanar manner between the longitudinal branches of the two conveyor belts 5 and extending from the rear return roller 6 to the front return roller 7 and a longitudinal side member 12**.

Figure 2:
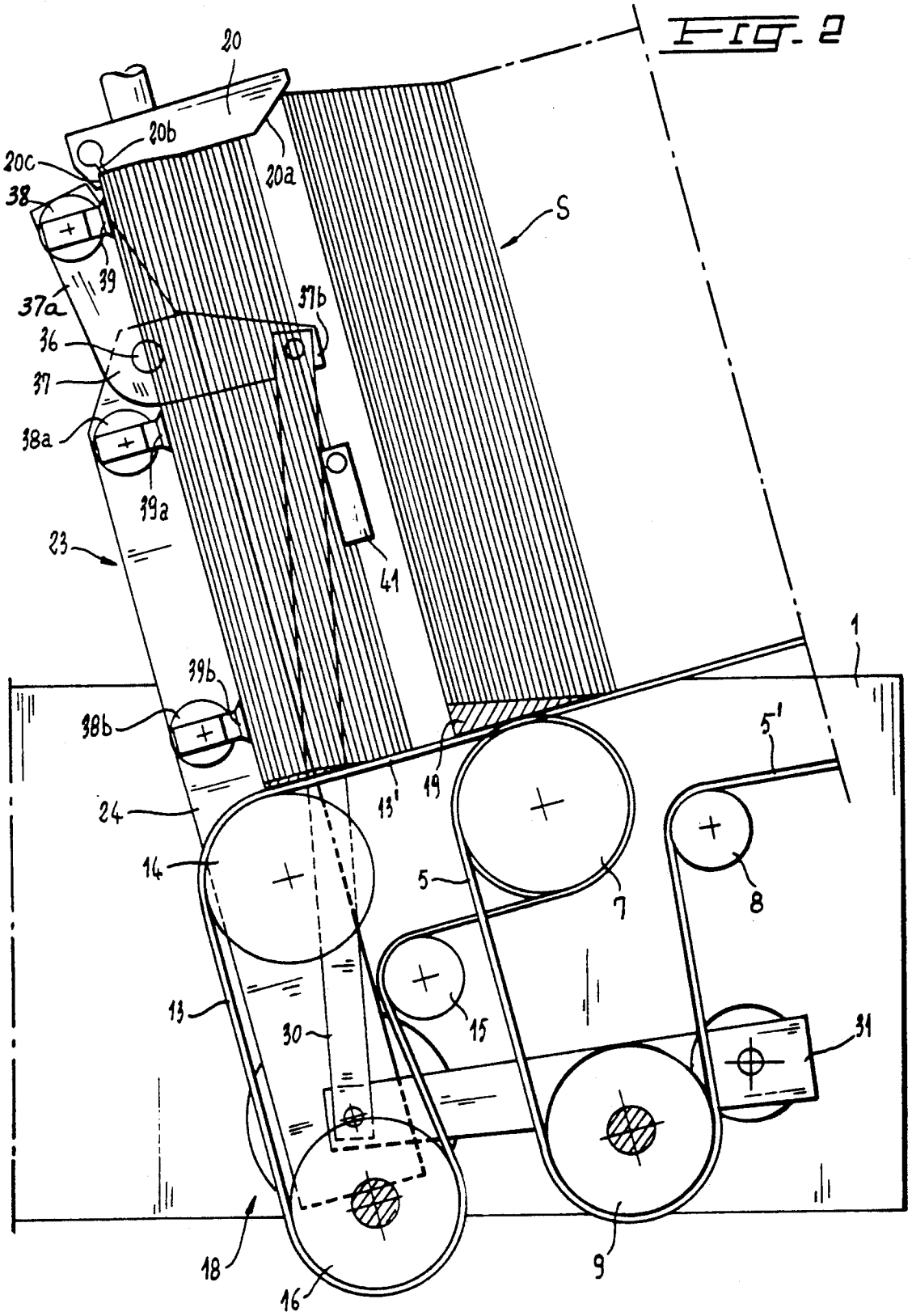
FIG. 2 is the downstream portion of the apparatus of FIG. 1 on an enlarged scale with the suction cup means in a first operative take-up position.
Figure 3:
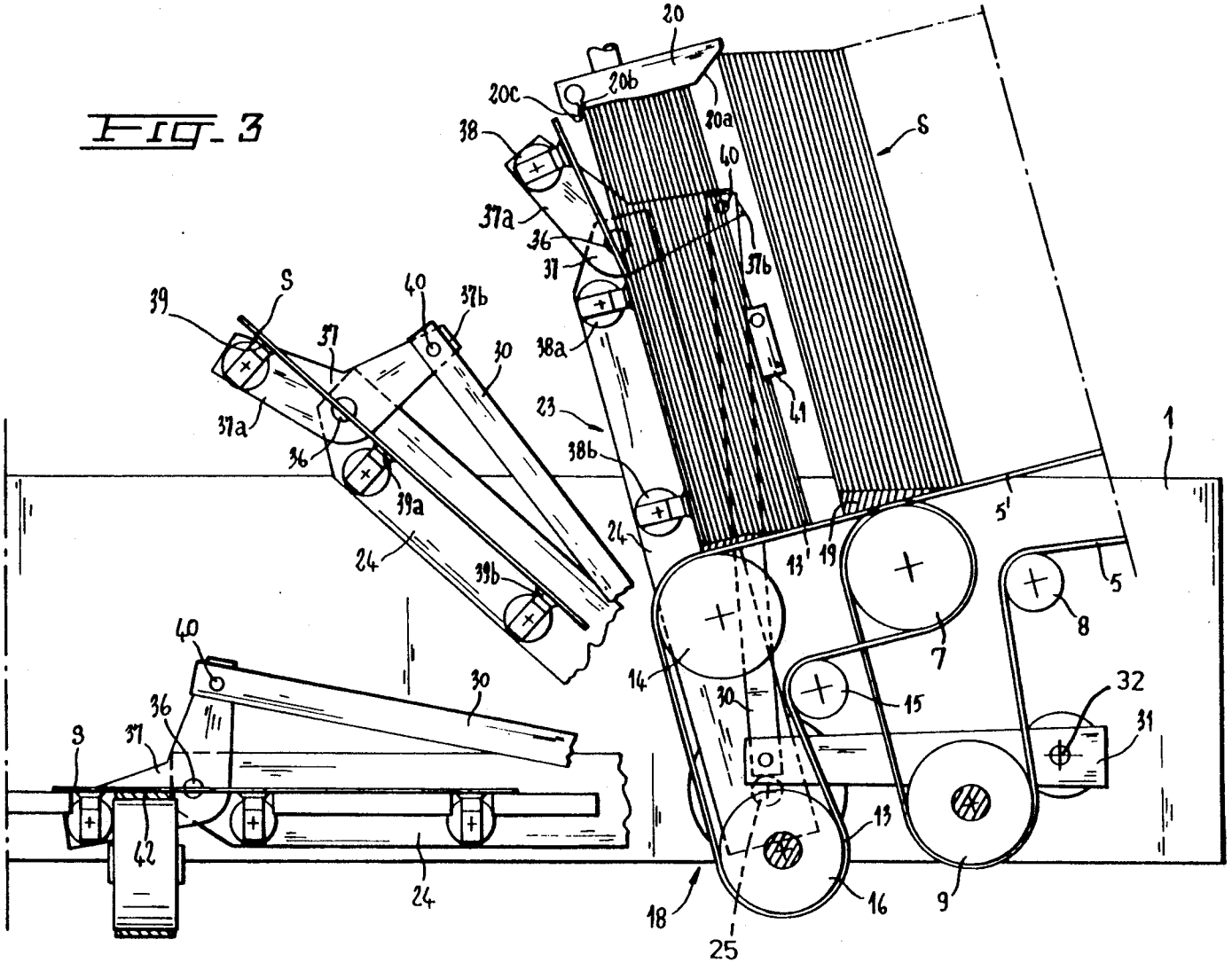
FIG. 3 is a similar view to FIG. 2 with the suction cup means in three different successive operative take-up positions.

The return roller 7 also has wound about it two further conveyor belts 13' and 13'' which are also spaced in a transversely parallel manner between and coplanar with the belts 5 and wound in closed-loop form about corresponding return rollers 14, 15 and 16, the latter also being driven by a geared motor 17 forming, in the manner which will be described below, a divider device shown overall by 18 (see FIGS. 2 and 3 as well).

At the downstream end of the slide plate 11, the latter rises in a plane 19 inclined upwards in the downstream direction and above the conveyor belts 13 forming, in the manner described above, the divider device 18 and there is disposed as a close continuation of this inclined plane 19 a plate 20 with a plane 20*a* inclined in the opposite direction to the inclined plane 19, which plate 20 with the inclined plane 20*a* is supported by support means 21 so that it can be vertically adjusted by screw means and a control wheel of known type shown by 22.

The assembly formed by the inclined plane 19 of the slide plate 11 and the inclined plane surface 20*a* of the plate 20 forms, as will be described in detail below, substantially static separation means in combination with an air current which is constantly provided and aimed at the blanks in the immediate vicinity of their point of take up.

This air current 20*b* is emitted through the plate 20 with the inclined plane 20*a*, which plate 20 also has a stop 20*c* for the blanks S being taken up.

Figure 4:
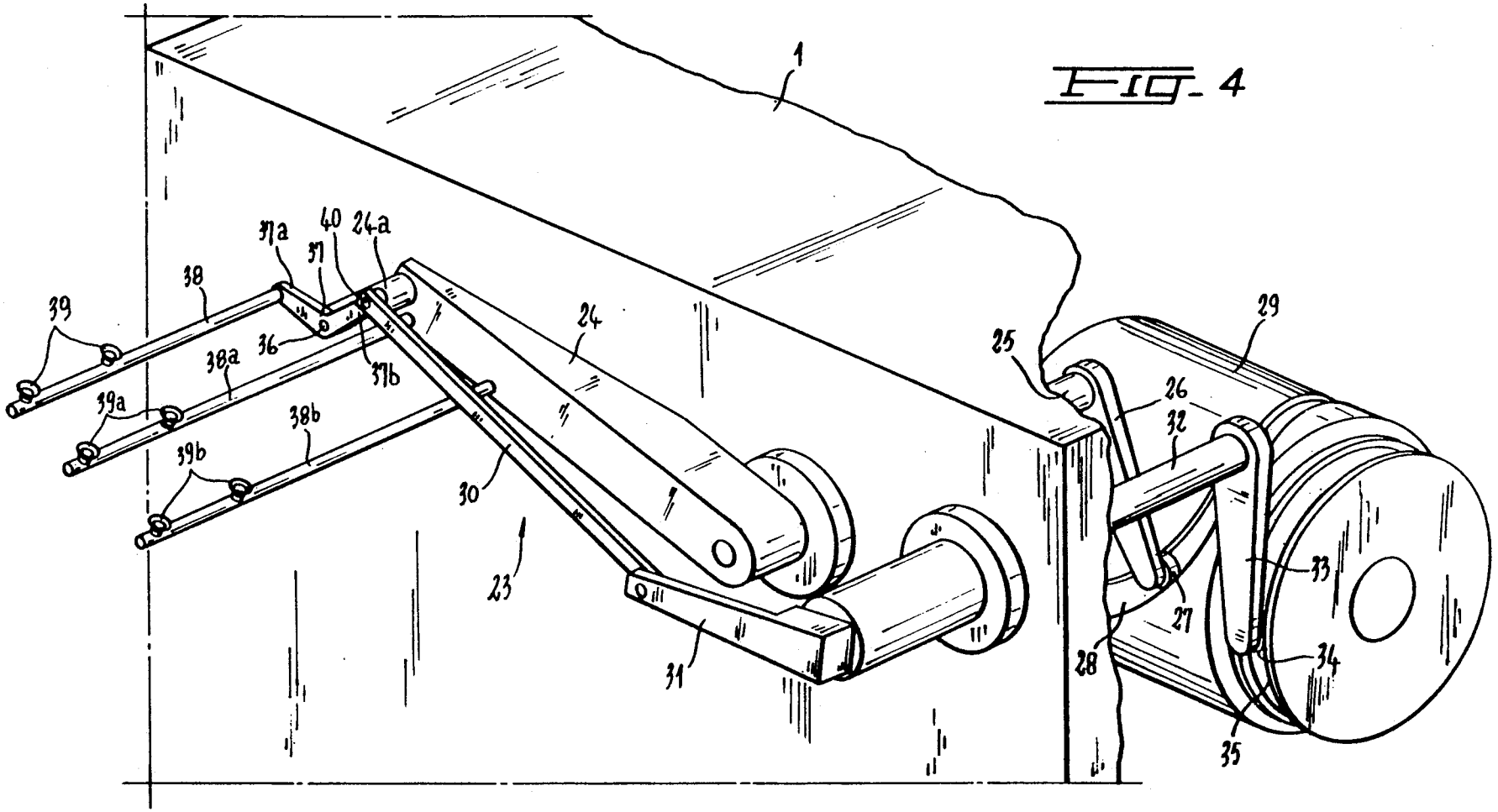
FIG. 4 is a diagrammatic perspective view of the operating structure of these suction cup means.

A device with suction cup means shown overall by 23 is disposed downstream of the divider device 18 and the substantially static separation means described above. A device 23 of this type is essentially formed by a structure substantially in the form of an articulated quadrilateral comprising (see FIG. 4 in particular) a first lever 24, one end of which is keyed on one end of a spindle 25 supported in a rotary manner on the base 1 and whose other end is keyed on one end of a lever 26 bearing at its other end a cam follower roller 27 engaged in a first cam groove 28 of a cam drum 29 driven in a conventional manner by the kinematic mechanism of the apparatus in question, and a second lever 30 articulated at one end on one end of a lever 31 whose other end is keyed on one end of a spindle 32 which is also supported in a rotary manner on the base 1 parallel to the spindle 25 and whose other end is keyed on one end of a second lever 33 bearing at its other end a cam follower roller 34 engaged in a second cam groove 35 of the cam drum 29. The other end of the first lever 24 is provided with a sleeve member 24*a* supporting in a rotary manner via a pin 36 a lever 37 with two angled arms 37*a* and 37*b*. the free end of the first of which is snap-locked to a rod 38 bearing two suction cups 39 designed to take up, as will be explained below, the flat blanks from the store 4 in individual sequence, while the free end of the second arm 37*b* is articulated at 40 on the other end of the second lever 30. Lastly, two further rods 38*a* and 38*b* provided with corresponding suction cups 39*a* and 39*b* spaced in parallel are supported in a snap-locking manner by the lever 24.

A particularly important feature of the device 23 with suction cup means described above lies in the coaxial nature of the articulation of the lever 24 with its rotary keying spindle 25 and the articulation between the lever 30 and the corresponding lever 31.

When the plane blanks S are stacked sideways on the inclined plane formed by the conveyor belts 5 and the slide plate 11 of the store 4 from upstream, i.e. from the highest point of the inclined plane 19, for instance towards downstream, and arranged so that they are supported on the counter-inclined plane 20*a* of the corresponding upper support plate 20, and when the above-described apparatus has been started by actuating the geared motor 17 actuating the divider device 18 with conveyor belts 13 and, via the photocell 41, the geared motor 10 actuating the store 4 with conveyor belts 5, the blanks S are caused to fall in individual sequence from the inclined plane 19 onto the belts 13 of the divider device 18 in a quantity predetermined by the position occupied by the photocell 41, causing the blanks to be separated in this way via the respective relative movement caused by the particular arrangement of the inclined planes 19 and 20*a*. In the meantime, the device 23 with suction cup means supplies (see FIGS. 2 and 3) the blanks in individual sequence in a horizontal position on a conveyor 42 of a handling machine therefor, for instance the machine disclosed in the Patent Application 3687 A/89 filed on the same date as this application in the name of the applicants, by firstly freeing their upper portion from the stop 20*c* and then transferring them into this horizontal position on the conveyor 42 (see FIG. 3 in particular).

The description of the apparatus in question made with reference to the accompanying drawings is obviously given solely by way of example and it is therefore evident that all those modifications and variants suggested by practice and by its embodiment and use can be made thereto without departing from the scope of the following claims.

I claim:

1. An apparatus for supplying individual flat blanks, said apparatus comprising:

an elongated frame formed with upstream and downstream ends;

an upstream pair of parallel and spaced apart closed-loop conveyor belts mounted on said frame and inclined to a horizontal for conveying a plurality of uniform flat blanks along a path thereof;

dividing means on said frame along said path downstream of said upstream conveyor belts for portioning said plurality of flat blanks in divided sequences of a predetermined number of said blanks, said dividing means comprising:

first means forming a first surface lying in a first plane and slidably receiving said flat blanks, second means forming a second surface lying in a second plane inclined to said first plane and mounted on said frame immediately downstream from and above said first means at a distance corresponding to an upright dimension of each of said flat blanks stacked side by side between said first and second surfaces, control means for detecting said predetermined number of blanks, a downstream pair of parallel and spaced apart closed loop conveyor belts mounted on said frame and forming a continuation of a path of said upstream belts for advancing said predetermined number of flat blanks while urging same against said second surface toward said downstream end of said frame; and alternately oscillating means downstream of said dividing means for taking up individually said flat blanks from said predetermined number and for depositing said individual blanks horizontally on a production line.

2. The apparatus defined in claim 1 wherein said oscillating means includes:

a cam drum mounted rotatably on said frame, a supporting lever formed with a respective inner end mounted rotatably on said frame and operatively connected with said cam drum and formed with a respective outer end, said supporting lever oscillating about said inner end between first and second angular positions thereof upon rotation of said cam drum, a rotary lever mounted on said supporting lever for oscillating therewith, said rotary lever being formed with:

a first arm mounted rotatably on said outer end of the supporting lever for pivoting of said rotary lever between a respective first angular position thereof corresponding to said first position of said supporting lever and a respective second angular position, each of said sheets being separated from said the predetermined sequence in said second angular position of the rotator lever, and a second arm extending at an angle from said first arm, a control lever formed with a respective inner end operatively connected with said cam drum and with a respective outer end connected with said second arm of said rotary lever for controlling the first and second angular positions of said rotator lever, suction means mounted on said second arm of the rotary lever for picking up each of said flat blanks of said predetermined sequence from said downstream pair of conveyor belts in said first angular position of said rotary lever and for horizontally depositing individual blanks on a production line juxtaposed with said downstream limit of said frame in said second angular position of said supporting lever.

3. The apparatus defined in claim 2 wherein said suction means is a plurality of supports provided with suction cups.

4. The apparatus defined in claim 2 wherein the inner end of said control lever is loosely mounted on a connecting lever formed with a first spindle mounted rotatably on said frame and actuated by said cam drum, the inner end of said supporting lever being mounted on a first end of a second spindle rotatable by said cum drum through a connecting member mounted on an opposite end of said second spindle.

5. The apparatus defined in claim 4 wherein said first and second spindles are rotatable about respective parallel axes, said rotary lever being pivotal about a pivotal axis parallel to said axes of first and second spindles.

* * * * *